US005238260A

United States Patent [19]

Scherübl

[11] Patent Number: 5,238,260

[45] Date of Patent: Aug. 24, 1993

[54] SKI

[75] Inventor: Franz Scherübl, Mauerbach, Austria

[73] Assignee: Atomic Skifabrik Alois Rohrmoser, Wagrain, Austria

[21] Appl. No.: 900,547

[22] Filed: Jun. 18, 1992

Related U.S. Application Data

[63] Continuation of Ser. No. 543,710, Jun. 26, 1990, abandoned.

[30] Foreign Application Priority Data

Jun. 26, 1989 [AT] Austria ..... 1561/89

[51] Int. Cl.[5] ..... A63C 5/00

[52] U.S. Cl. ..... 280/610

[58] Field of Search ..... 280/608, 610, 602, 609

[56] References Cited

U.S. PATENT DOCUMENTS

| | | | |
|---|---|---|---|
| 2,995,379 | 8/1961 | Head | 280/610 |
| 3,844,576 | 10/1974 | Schultes | 280/610 |
| 4,455,037 | 6/1984 | Pilpel et al. | 280/610 |
| 5,002,300 | 3/1991 | Pascal et al. | 280/610 X |

*Primary Examiner*—Richard M. Camby
*Attorney, Agent, or Firm*—Collard & Roe

[57] ABSTRACT

A ski comprising a multi-layered top web, a multi-layered bottom web, the webs having a sandwich web including a web core and two layers covering respective surfaces of the web core incorporated therein, a ski core arranged between the top and bottom webs, respective side ledges extending along the ski core, and respective side edges extending along the top and bottom webs.

34 Claims, 6 Drawing Sheets

Fig. 9
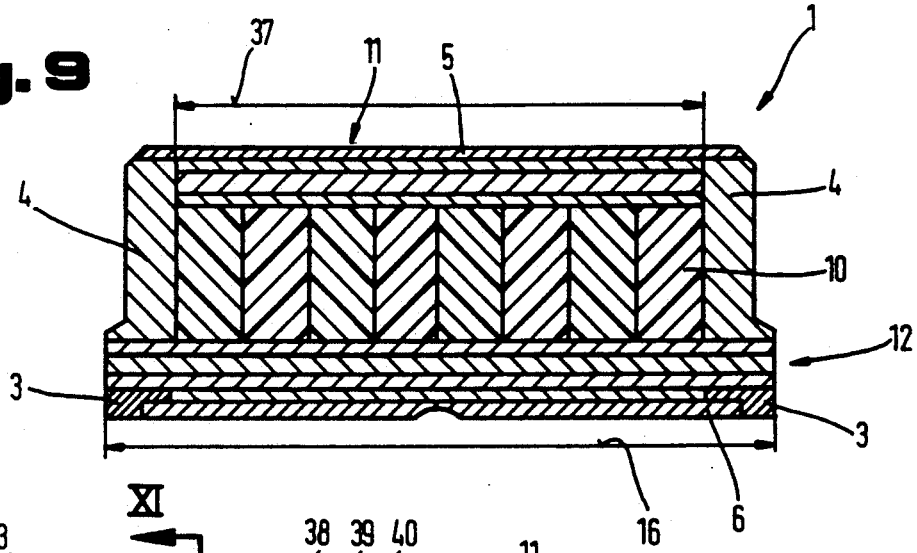
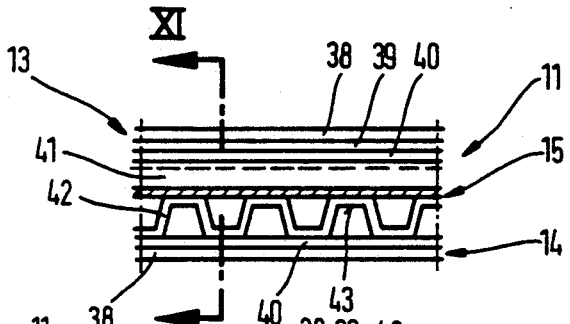
Fig. 10
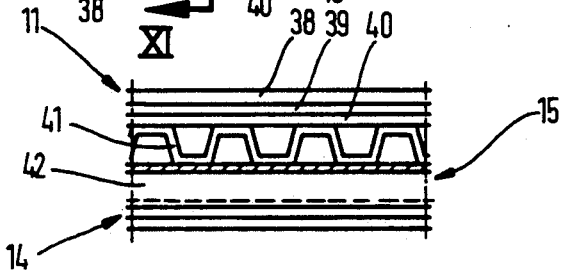
Fig. 11
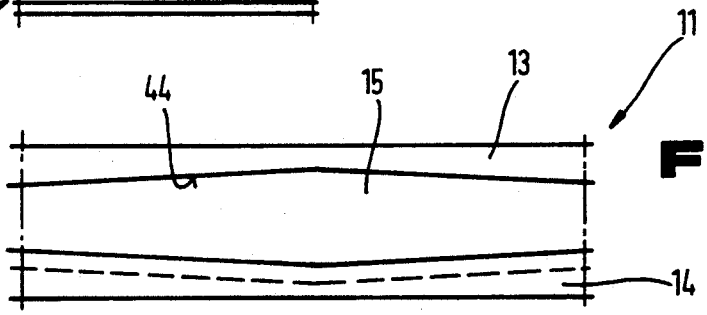
Fig. 12
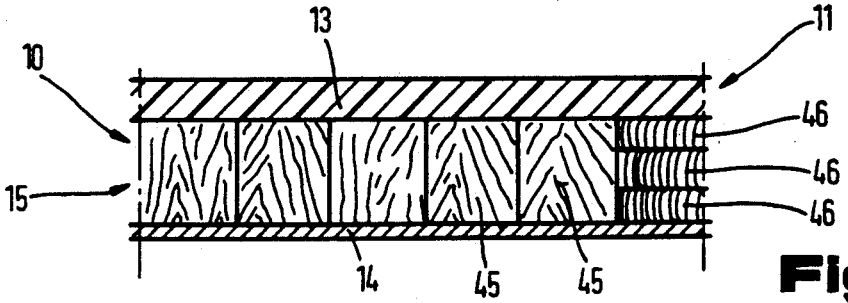
Fig. 13

SKI

This is a continuation of my copending application Ser. No. 07/543,710, filed Jun. 26, 1990, now abandoned.

BACKGROUND OF THE INVENTION

1. Field of the Invention

The present invention relates to a ski comprising a multi-layered top web, a multi-layered bottom web, a ski core arranged between the top and bottom webs, respective side ledges extending along the ski core and respective side edges extending along the top and bottom webs, the webs preferably comprising a surface and a tread layer, respectively.

2. Description of the Prior Art

Laminated skis with various layer structures are known. Basically, these multi-layered skis are comprised of a sandwich element whose multi-layer top web usually incorporates a surface layer and whose multi-layer bottom web usually incorporates a tread layer. A ski core of various materials is interposed between the top and bottom webs. For example, the ski core may be comprised of an aluminum profile, a honeycomb element of carton or sheet metal, an element of trapezoidal cross section, various types of multi-piece wood inserts or a synthetic resin foam element.

In one known ski, the surface layer is constituted by an imprinted aluminum band with lacquer coating. A fiberglass laminate is disposed therebelow, wherebelow an upper hard wood core is arranged and this is connected to a lower core of soft wood, with the interposition of a fiberglass laminate. A layer consisting of an aluminum band and a fiberglass laminate is arranged between the lower soft wood core and the tread layer. Rubber strips are inserted between the aluminum band and the fiberglass laminate adjacent the side edges. The side ledges are made of phenol and the bottom side edges are of steel. Laminated skis of this type have been very successfully used, particularly in downhill skiing.

SUMMARY OF THE INVENTION

It is the primary object of this invention to improve a laminated ski of the first-described type in a manner that assures a good fall and has satisfactory shock absorbing properties under various conditions.

The above and other objects are accomplished according to the invention by incorporating a sandwich web including a web core and two layers covering respective surfaces of the web core in the top and/or the bottom web.

Such a sandwich web has the unexpected advantage of providing a ski reinforcement element of exactly defined characteristics, the synergistic cooperation between web core and covering layers producing an improved stress distribution and a more favorable development of the tension resulting from flexing. In addition and surprisingly, this arrangement enables the deformation resistance to be held substantially constant over an extended temperature range. If two such sandwich webs are arranged symmetrically with respect to the ski core on opposite sides thereof, substantially identical operating conditions with respect to rigidity and shock absorption will be achieved under different deformations.

BRIEF DESCRIPTION OF THE DRAWING

The above and other objects, advantages and features of this invention will become more apparent from the following detailed description of certain now preferred embodiments thereof, taken in conjunction with the accompanying drawing wherein

FIG. 9 is a like view showing yet another embodiment;

FIG. 10 is a like fragmentary cross section of a further embodiment of the sandwich web;

FIG. 11 is a longitudinal section along line XI—XI of FIG. 10;

FIG. 12 illustrates another modification of a sandwich web;

FIG. 13 is a fragementary transverse cross section of yet another embodiment of the sandwich web;

DETAILED DESCRIPTION OF PREFERRED EMBODIMENTS

Figure 1:
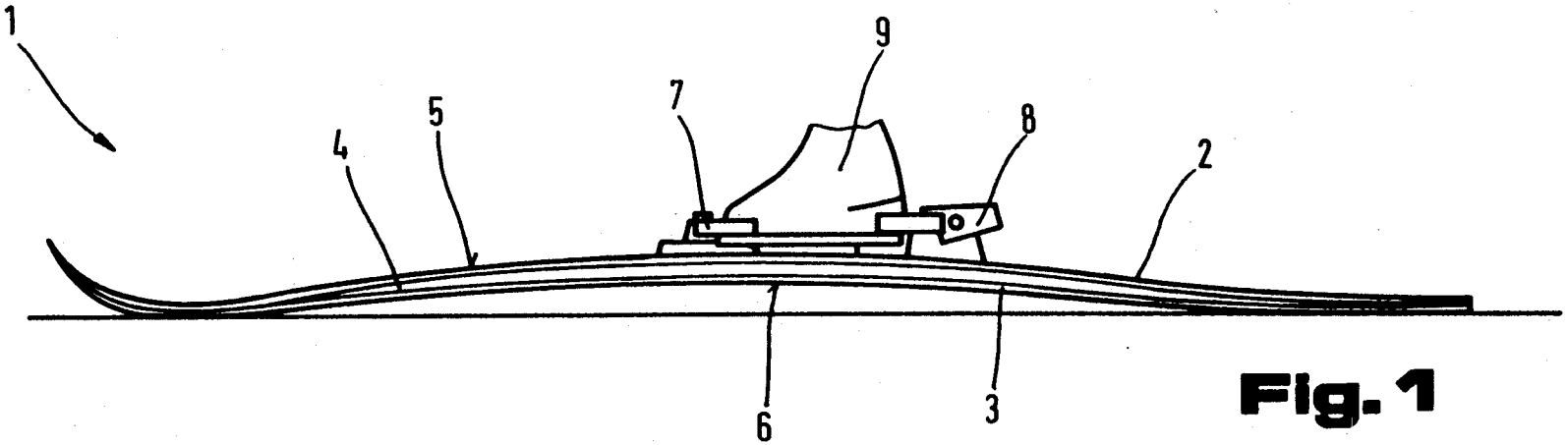
FIG. 1 is a side elevational schematic view of a ski.
Figure 2:
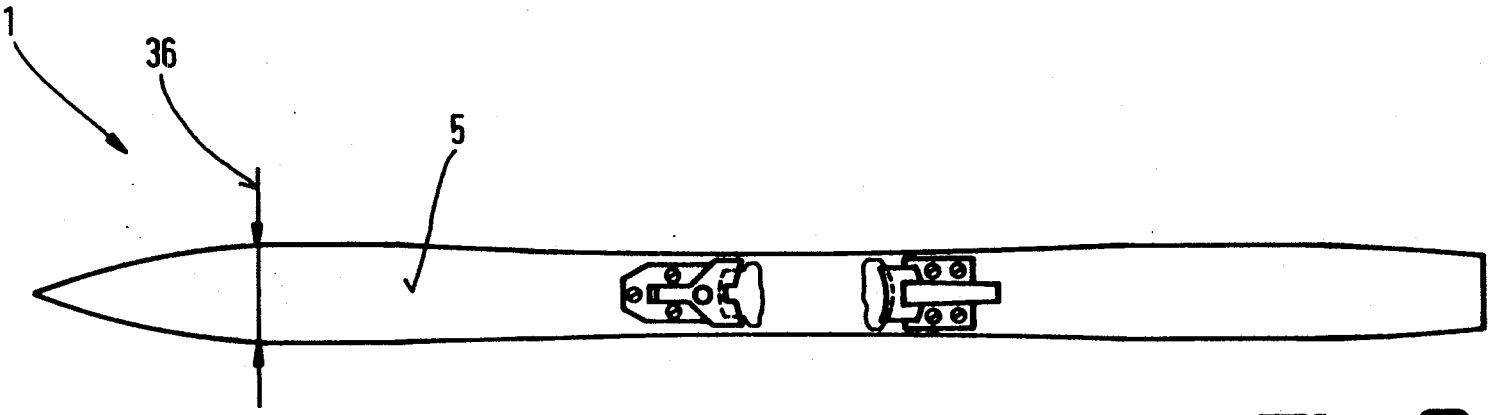
FIG. 2 shows the ski of FIG. 1 in top view.

Referring now to the drawing, wherein like reference numerals designate like parts functioning in a like manner, FIGS. 1 and 2 diagrammatically illustrate ski 1 comprising upper side edges 2, lower side edges 3 and side ledges 4 extending between the side edges on each side of the ski. The illustrated ski also has top surface layer 5 and bottom tread layer 6. A ski binding comprised of front jaw 7 and rear jaw 8 is mounted on the top surface layer intermediate the ski ends for holding boot 9 of a skier.

As shown in the subsequent figures, ski 1 comprises a multi-layered top web, a multi-layered bottom web and ski core 10 arranged between the top and bottom webs, side ledges 4 extending along the ski core and side edges 3 extending along the top and bottom webs. In the illustrated embodiments, ski core 10 is comprised of adjoining wood or synthetic resin bars extending in the direction of longitudinal extension of ski 1 and glued or otherwise bonded together. At least one of the webs has sandwich web 11, 12 incorporated therein, each sandwich web including web core 15, 20 and two layers 13, 14 and 19, 21 covering respective surfaces of web core 15 and 20.

Figure 3:
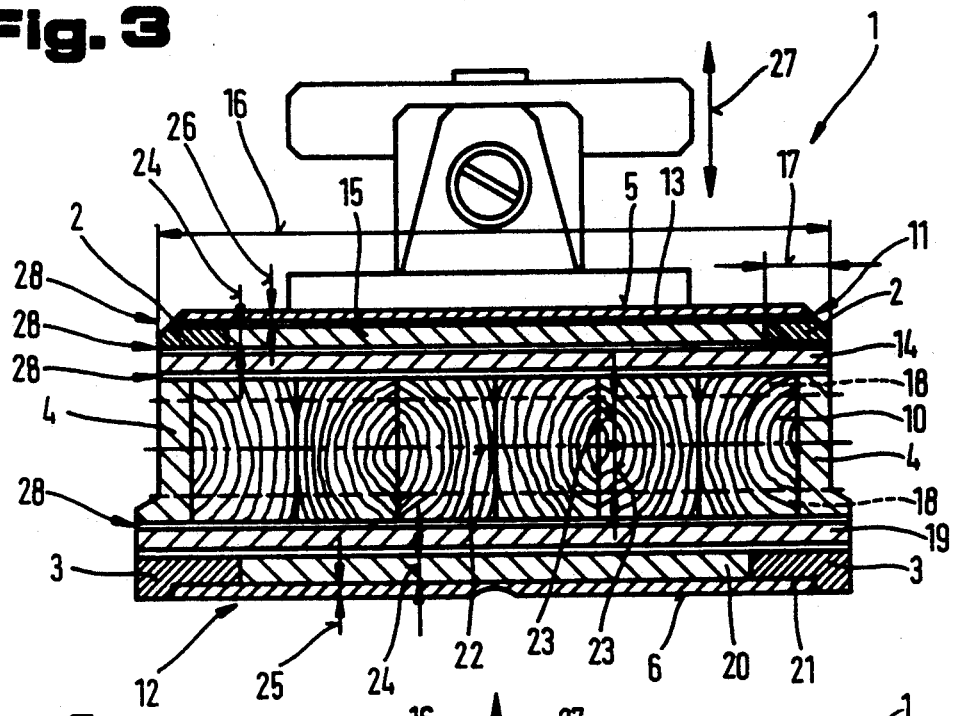
FIGS. 3 to 7 are transverse cross sections of the ski, illustrating different embodiments of the invention.

In the embodiment of FIG. 3, sandwich web 11 is incorporated in the top web and sandwich web 12 is incorporated in the bottom web, i.e. the top and bottom webs are constituted by the sandwich webs. Covering layer 13 of sandwich web 11 is constituted by surface layer 5 and covering layer 21 of sandwich web 12 is constituted by tread layer 6. This arrangement reduces the height or thickness of the ski so that this ski dimension may be held within conventional parameters even when two sandwich webs are combined with the ski core. The covering layers and the web core of sandwich webs 11, 12 are substantially similarly arranged and are of a substantially like structure, being mirror-symmetrically arranged with respect to ski core 10. This arrangement enables the desired stress orientation and resistance to deformation to be maintained over a long operating life of the ski and to minimize or prevent internal stresses to occur at different temperatures or under different loads. The mirror-symmetrical arrangement assures a like shock absorption with opposite deformations with respect to the longitudinal axis of the ski.

Covering layer 14 of sandwich web 11 is constituted by an insert of glass fiber reinforced synthetic resin while web core 15 is comprised of an aluminum band. While covering layers 13, 14 extend over width 16 of the ski, web core 15 extends between side edges 2, 2, i.e. over a width reduced by widths 17 of the side edges. Covering layer 14 is directly bonded to ski core 10 and side ledges 4. However, as indicated by a broken line, an intermediate bonding layer 18, which may consist of a glass fiber reinforced synthetic resin or a shock-absorbing rubber insert, may be used for connecting covering layer 14 to ski core 10 and side ledges 4.

At the opposite side of ski core 10, sandwich web 12 is comprised of covering layer 19, web core 20 and covering layer 21 constituted by tread layer 6, the covering layers again extending over width 16 while the web core is embedded between side edges 3 over a width reduced by the widths of the side edges. The two sandwich webs are mirror-symmetrically arranged with respect to a plane of symmetry or neutral zone 22, indicated by a broken line, i.e. they have the same distance 23 therefrom. The web cores of the sandwich webs have the sam thickness 24 and although layer thickness 25 of tread layer 6 (covering layer 21) slightly exceeds thickness 26 of surface layer 5 (covering layer 13), these covering layer thicknesses of sandwich webs 11, 12 are so selected with respect to the different materials used for layers 13 and 21 that they will exhibit the same resistance to deformation of ski 1 in a direction extending perpendicularly to tread layer 6 (indicated by double-headed arrow 27).

Again, covering layer 19 of sandwich web 12 may be directly bonded to ski core 10 and side ledges 4 or, as indicated by broken line 18, an insert bonding layer of the same or a different material than that used in connection with sandwich web 11 may connect the covering layer to the ski core and side ledges.

As shown, side ledges 4, 4 are received between and connected to sandwich webs 11, 12, which reduces the danger of the side ledges becoming detached from the ski body. Side edges 2 and 3 are disposed on the sandwich webs whereby stress forces are directly transmitted from the sandwich webs to the side edges, thus assuring uniform deformation of these elements and reducing the danger of the side edges becoming detached. In other words, the side ledges and side edges are at least partially integrated in the sandwich webs.

If desired and as shown, bonding foils 28 may be used to laminate the layers of the sandwich webs and the sandwich webs and ski core. However, the lamination may also be effected by coating the covering layers with a pressure- and/or heat-activatable adhesive agent. This adhesive agent, which may be a synthetic resin, may be applied to the covering layers in pulverized or pasty form. It is also possible to use dry bonding foils between the layers which are liquefied under pressure and heat during lamination of the ski to bond the layers into a unified ski body. Using such bonding foils has the advantage no liquid or doughy masses are present when the layers are placed into the form in which the ski is laminated. It also avoids the danger that the adhesive is not applied over the entire surface of the layers, which may lead to delamination of the ski body during use.

Covering layers 13, 14, 19, 21, web cores 15, 20, ski core 10 and, when used, intermediate bonding layers 18 may be comprised of various materials, as presently used in multi-layered skis. The most advantageous effects of the sandwich webs will be obtained if the web core has a deformation resistance which is smaller than that of at least one of the covering layers. The web core may be of an elastically yielding material, such as natural or artificial rubber, cork, carton or the like, which enables the path of shock absorption between the web core and the covering layers and the resistance to deformation to be further varied. The covering layers of each sandwich web may be of different materials but have substantially the same flexing moment and/or shock absorbing property and/or thermal extensibility and/or hardness. If they have the same flexing moment, the materials used for the layers of the sandwich webs may have different shock absorbing properties and yet have the same rigidity. If they have the same shock absorbing property, thermal extensibility and hardness, they will produce sandwich webs exhibiting substantially the same operating qualities although the materials differ. Advantageously, the flexing moment of the sandwich webs is proportional to their distance from surface layer 5 and preferably decreases proportionally to the increase of this distance, which assures a substantially equal deformation stress for both sandwich webs and reduces the danger of the sandwich webs becoming detached from the ski core.

For example, covering layers 13, 14, 19, 21 may consist of glass fiber bands impregnated with a synthetic resin acting as a bonding agent for the fibrous material. Other very strong fibers or filaments, such as coal, "Kevlar", ceramic or the like, may be used instead of glass fibers, and these fibrous materials are formed into a net, woven fabric or unwoven web, coated with a pulverulent, pasty or liquid bonding agent, instead of being impregnated therewith, to obtain sandwich webs resistant to high stress, due to the high tensile strength of the fibers or filaments. The coating or impregnation of these layers with a pressure- and/or heat-activatable bonding agent enables the lamination to be effected without the use of additional bonding layers. The fibrous material for the covering layers may also consist of, or include, metallic fibers or filaments, such as titanium fibers, and other mineral fibers, and mixtures of various fibers and/or filaments may be used. The unwoven webs, woven fabrics or nets of the fibrous material may be so arranged as to impart a stiffness to the layer in a desired orientation. Furthermore, the covering layers may consist of bands of suitable synthetic resins or aluminum.

Web cores 15, 20 may consist of any of the above materials, of wood or wood veneer, such as ash wood veneer, or of elastically yielding materials, such as natural or synthetic rubber, synthetic resin foam, for example soft polyurethane or polystyrene foam, and the like.

These various materials for the covering layers and/or the web core are selected so as to obtain layers having a long operating life and good deformation characteristics at the lowest possible costs, making use of readily available standard materials. When elastically yielding materials are used for some of the layers, the shock absorption may be distributed over the height or thickness of the ski to respective selected layers.

Figure 4:
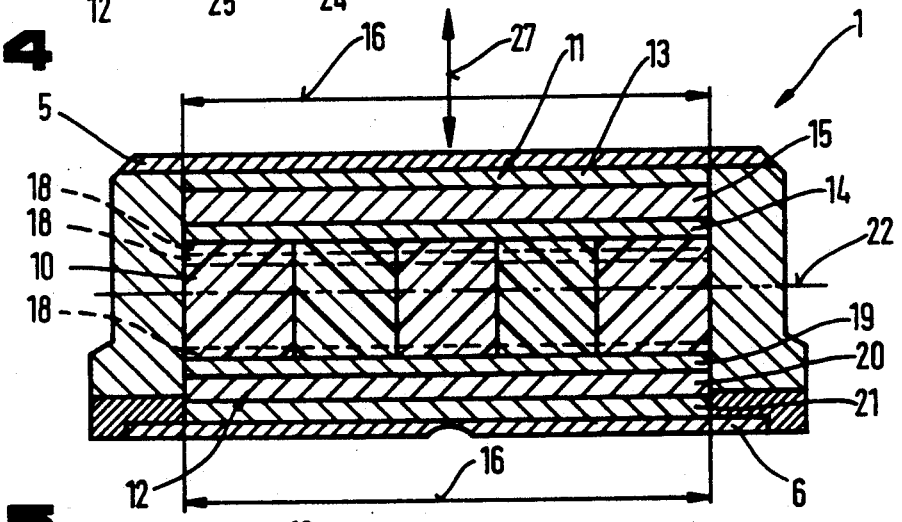

As in FIG. 3, the cross section of FIG. 4 is also taken at the ski binding. In this embodiment, sandwich webs 11, 12 extend over the same width 16 between the side ledges of the ski, covering layers 13, 14, 19, 21 and web cores 15, 20 having the same width. In this embodiment, as in the embodiment of FIG. 9, the upper side edges are formed by the upper ends of the side ledges. The sandwich webs are respectively covered by surface layer 5 and tread layer 6, and these layers do not form part of the sandwich webs. As shown by broken lines, an intermediate bonding layer or a plurality of such layers may be inserted between ski core 10 and the sandwich webs. The multi-layered top web of this ski is constituted by surface layer 5, sandwich web 11 and intermediate bonding layer(s) 18 while the bottom web is constituted by tread layer 6, sandwich web 12 and intermediate bonding layer(s) 18. In this arrangement, too, the sandwich webs are mirror-symmetrically arranged with, i.e. at the same distance from, neutral zone 22. This assures a uniform stress when ski 1 is deformed. Since the layers of the sandwich webs do not project to the lateral edges of ski 1, i.e. they are fully encased, it is possible to use UV-sensitive materials without causing disadvantageous changes in their properties when exposed to the sun.

Figure 5:
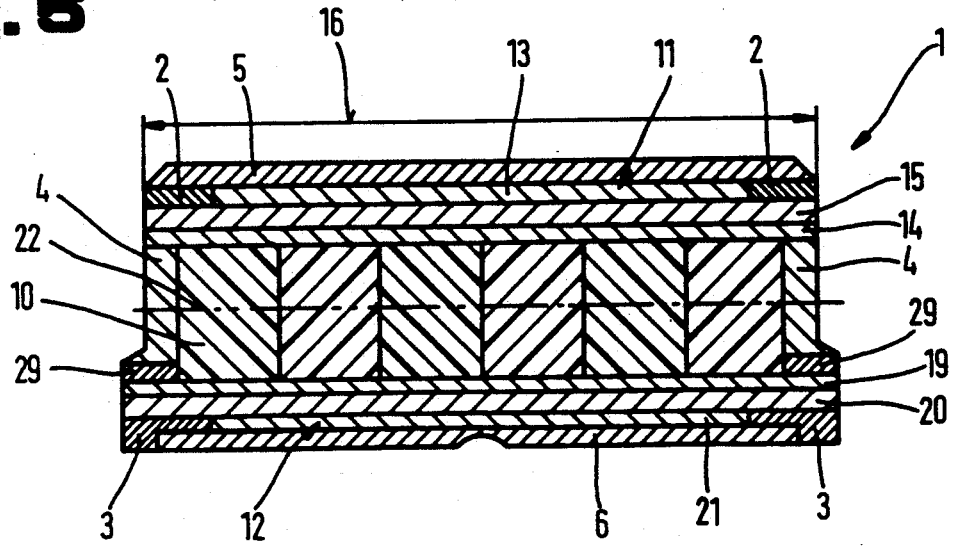

In the embodiment of FIG. 5, covering layer 13 of sandwich web 11 extends between the two upper side edges 2 of ski 1 and covering layer 21 of sandwich web 12 extends between the two lower side edges 3. On the other hand, web cores 15, 20 and covering layers 14, 19 of sandwich webs 11, 12 extend along the entire width 16 of the ski, i.e. covering layers 13, 21 have a smaller width than covering layers 14, 19 as well as web cores 15, 20. In this way, the ski has a greater resistance to deformation in the direction of tread layer 6 than in the opposite direction. Side ledges 4, 4 are received between sandwich webs 11, 12, as in the embodiment of FIG. 3, whereby the side ledges constitute spacers between the sandwich webs, and side edges 2, 3 are disposed on web cores 15, 20 of the sandwich webs, whereby lateral stresses are introduced directly into the sandwich webs. On the other hand, the sandwich webs are supported directly on ski core 10. Since covering layers 13 and 21 have the same width, the two sandwich webs again are mirror-symmetrically arranged with respect to neutral zone 22. This assures a symmetrical stress along ski 1, and this may be varied somewhat by incorporating additional layers in the body of the ski, such as shock-absorbing layers 29 between the lower ends of side ledges 4 and covering layer 19 of bottom sandwich web 12. Surface layer 5 and tread layer 6 may be selected independently of the structure of sandwich webs 11, 12.

Figure 6:
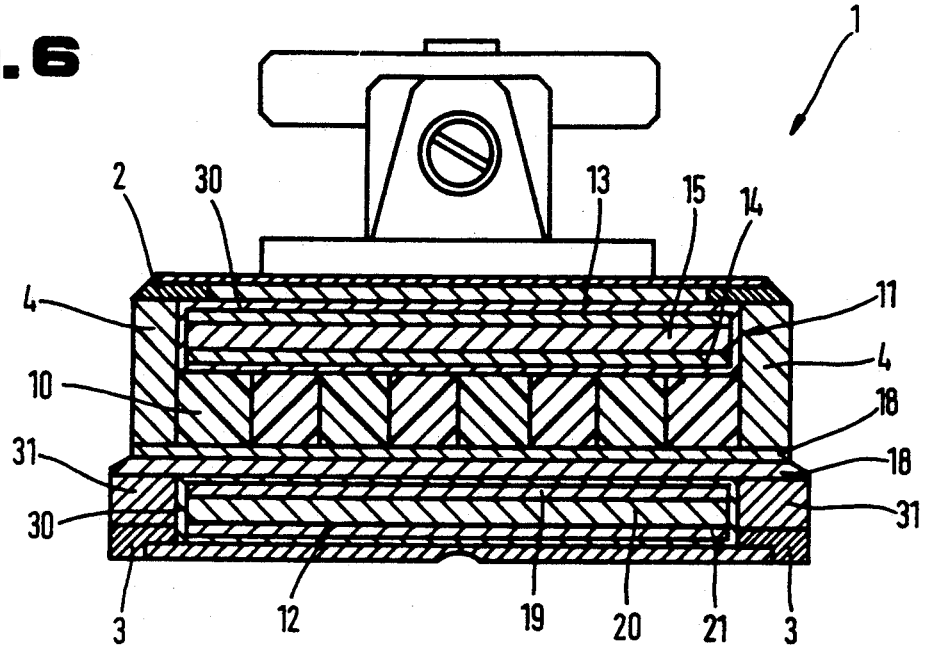

FIG. 6 illustrates an embodiment wherein two like sandwich webs 11, 12 are encased in ski 1 between the surface and tread layers, as in the embodiments of FIGS. 4 and 5. In this way, the surface and tread layers may conform to any desired use criteria and the sandwich webs may have the same structure, independently of the properties of the surface and tread layers. Preferably, covering layers 13, 14 and 19, 21 as well as web cores 15 and 20 are alike, i.e. they are made of the same materials having the same layer thicknesses and other dimensions and are similarly structured, i.e. the distances between the layers of the sandwich webs are the same. However, if desired, the layers and their spacing may differ from each other. As shown, intermediate layer 30 of an elastically yielding material envelops each sandwich web 11, 12 to extend between ski core 10 and the sandwich webs as well as between side edges 2, 3 and side ledges 4 and side ledge extensions 31, the side ledges and their extensions being separated by an intermediate bonding layer 18 which, however, may be omitted, in which case there will be no need for side ledge extensions. In this way, the sandwich layers will be displaceable relative to the ski core but such relative displacements will not cause the side edges and ledges to become dislodged.

It would also be possible to arrange top sandwich web 11 entirely between upper side edges 2, the sandwich web and the upper side edges having the same height. Furthermore, if another intermediate bonding layer 18 is inserted between the ski core and the top sandwich web, the side ledges will also include side ledge extensions on top of the ski.

Figure 7:
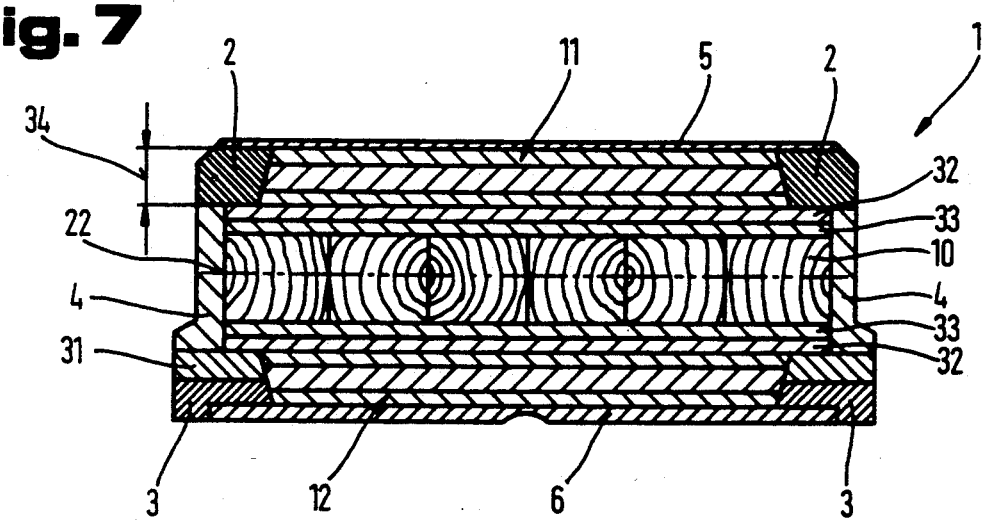
Figure 8:
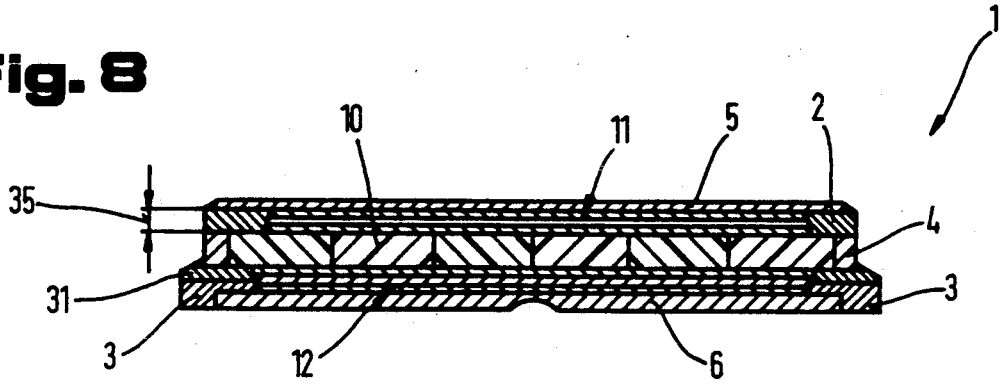
FIG. 8 is a like view showing the embodiment of FIG. 7 but at a point closer to the point of the ski.

In the embodiment of FIGS. 7 and 8, sandwich webs 11, 12 have a trapezoidal cross section and taper, respectively, towards surface layer 5 and tread layer 6 whereby a desired change in the resistance moment at the flexing of the sandwich webs may be accomplished in the direction of the taper of the sandwich web. Additional insert layers 32, 33 are arranged between sandwich webs 11, 12 and ski core 10 in the top and bottom webs of the ski. Additional insert layers may be arranged between the sandwich webs and the surface and tread layers, respectively. The number and the properties of these additional insert layers may be varied, or some or all of them may be omitted entirely. The use of such additional layers makes it possible to produce skis of various characteristics with the same sandwich webs. The inside faces of side edges 2, 3 and side ledge extensions 31 are adapted to the taper of the sandwich webs. If the trapezoidal sandwich webs taper towards ski core 10, they will overlap conformingly shaped side edges 2, 3, thus exerting a clamping force thereon and tending to hold them in position. The two sandwich webs are again mirror-symmetrically arranged with respect to neutral zone 22, thus enhancing the torsion properties of ski 1 and making it possible to produce a ski of trapezoidal cross section without reducing the cross section of the side edges.

As FIG. 8 taken in a region of the ski closer to its tip shows, thickness 34 of the sandwich webs in the region of the binding is reduced to thickness 35 near the tip (and, if desired, also towards the rear end). The reduced thickness of the sandwich webs towards the opposite ends of the ski and away from the ski binding enables the resistance moment of the ski against deformation to be varied in accordance with the specific use to which the ski is to be put. By suitably selecting the development of the sandwich web thicknesses along the length of the ski as well as their width 36, indicated in FIG. 2, the rigidity of sandwich webs 11, 12 and thus the stress resistance of ski 1 as a whole may be freely chosen independently of the stiffness or torsion resistance of the respective sandwich webs and in dependence on the materials of the individual layers and their spacing from each other.

In the embodiment of FIG. 9, width 37 of sandwich web 11 is less than width 16 of sandwich web 12, which has the same width as the combined width of tread layer 6 and lower side edges 3 of ski 1. The different widths of the sandwich webs and, optionally, different gages of the sandwich web layers and/or their spacing from each other, the stress in ski 1 may differ, depending on whether the ski is flexed in the direction of tread layer 6 or of surface layer 5. This may be desirable since the weight of the skier will require stronger shock absorption when passing through a trough than when the skier moves in a manner causing the ski to be lifted off the snow so that the reaction to the downward pressure on the ski towards tread layer 6 causes a deformation of the ski in the direction of surface layer 5.

FIGS. 10 and 11 illustrate an embodiment in which covering layer 13 of sandwich web 11 is comprised of several laminae 38, 39, 40 and covering layer 14 is comprised of laminae 38, 40. The number of laminae may vary and the laminae may be of different materials and/or different thicknesses. Web core 15 is also comprised of several laminae 41, 42. By selecting the number and the composition of the laminae, skis having different operational characteristics may be readily produced from an available stock of standard components from which the selection is made. The selection of the web core laminae, in particular, will enable the shock absorption qualities of the ski to be most accurately determined. The materials and/or gages of the covering layers or their laminae may be so selected that the layers extending in the direction subjected to the main stresses may have a higher tensile strength while the web core materials primarily subjected to pressure have higher elastic properties in the longitudinal extension of the ski to avoid deformation or detachment of layers from each other. For example, one of the covering layers may be comprised of a perforated band of metal or synthetic resin, such a layer having great tensile strength while its perforation may simply and effectively vary the elasticity and deformation properties of the layer to assume desired values.

In the embodiment of FIGS. 10 and 11, laminae 41 and 42 are comprised of profiled bands having trapezoidal ribs 43 oriented in directions staggered from each other, the illustrated profiled bands being offset by 90., which produces a fine tuning of the shock absorption properties and enhances the stiffness of sandwich web 11 in substantially all directions. Such profiled bands may be made of metal, synthetic resin and the like. Sandwich web 12 may be of the same structure as sandwich web 11 and may be mirror-symmetrically arranged, or the trapezoidal ribs of the profiled bands may have a different height or width.

Sandwich web 11 illustrated in FIG. 12 comprises covering layers 13, 14 which vary in thickness in a direction extending transversely to the longitudinal extension of the ski. This produces support areas of varying strength within the sandwich web functioning like a spatial framework. In the illustrated embodiment, each covering layer has a V-shaped recess 44 facing web core 15 which has a conforming surface shape fitting into the recess and varying in thickness across the ski so that the cross section of the sandwich web remains rectangular. Depending on the thickness variations, the resistance to deformation, particularly the resistance to torsion, may be adjusted. If desired, the covering layers as well as the web core may be comprised of several laminae.

FIG. 13 illustrates a sandwich web 11 whose covering layer 13 is comprised of synthetic resin, which may be fiberglass reinforced while covering layer 14 is comprised of aluminum sheet of average rigidity. Web core 15 is comprised of several wooden bars 45 extending in the direction of the longitudinal extension of the ski. However, as shown at the right in FIG. 13, the web core may also be comprised of several superposed layers 46 of veneer. The wooden bars or the veneer layers may be glued together or otherwise bonded by any suitable, preferably water-resistant, adhesive.

Figure 14:
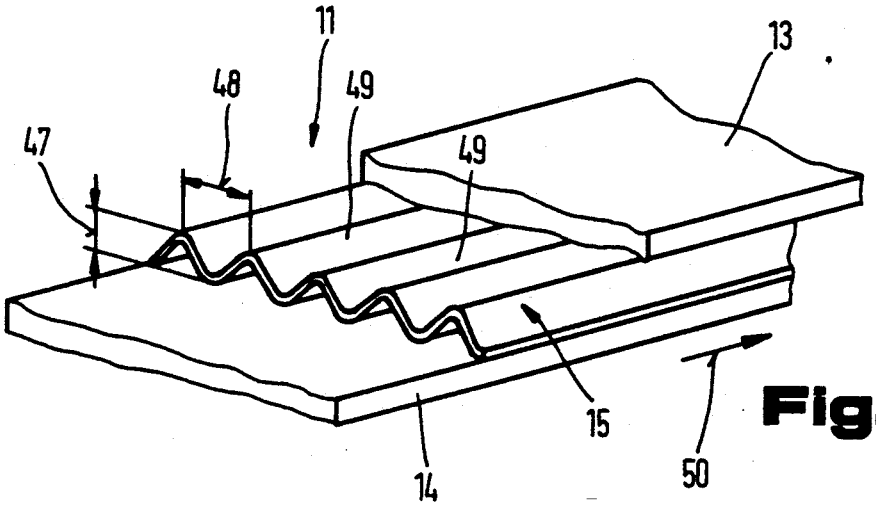
FIGS. 14 to 16 are simplified perspective views of different embodiments of the sandwich web.
Figure 15:
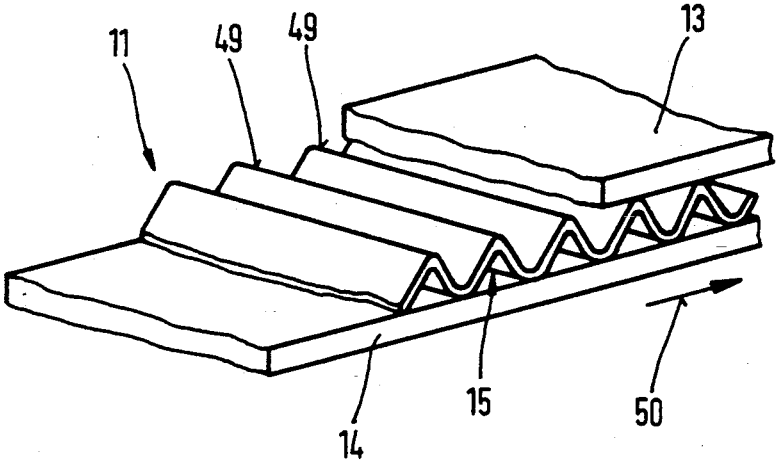
Figure 16:
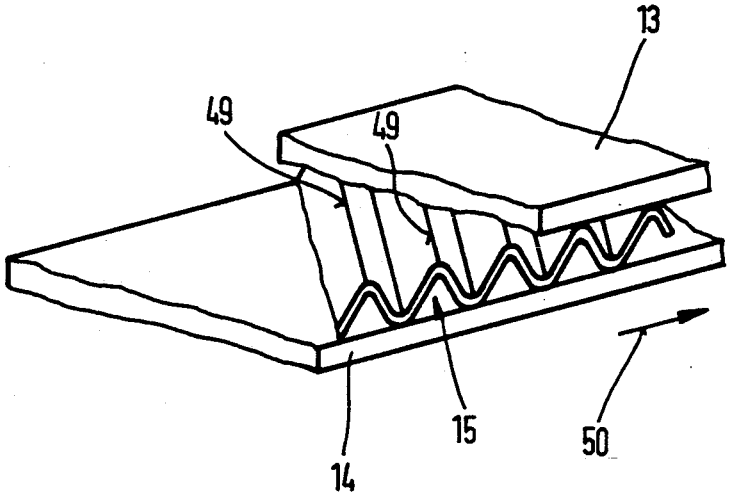

In the sandwich webs of FIGS. 14 to 16, web core 15 is comprised of a corrugated band disposed between covering layers 13 and 14. This corrugated band may be comprised of a thin metal foil, carton, a pressed unwoven fibrous web or a synthetic resin sheet. By suitably selecting height 47 of ribs 49 of the corrugated web core, the resistance to deformation and the shock absorbing properties of the sandwich web may be readily varied to produce skis for different uses. In the embodiment of FIG. 14, ribs 49 extend substantially parallel to the longitudinal extension of the ski, indicated by arrow 50. This produces increased rigidity against flexing in the main direction of stress. In the embodiments of FIGS. 15 and 16, ribs 49 extend transversely to the longitudinal extension of the ski, i.e. perpendicularly thereto (FIG. 15) or obliquely with respect thereto (FIG. 16). With the arrangement of FIG. 15, the torsion characteristics of the ski may be varied while the oblique arrangement of FIG. 16 enables the longitudinal flexing as well as the torsion characteristics of the ski to be varied.

If desired and similarly to the embodiment of FIGS. 10 and 11, web core 15 may be comprised of two or more superposed layers of corrugated bands, in which case the orientations of ribs 49 may be offset from each other by 90° or any other angle. The rigidity of the sandwich web may be further varied by suitable selection of the layer materials.

Figure 17:
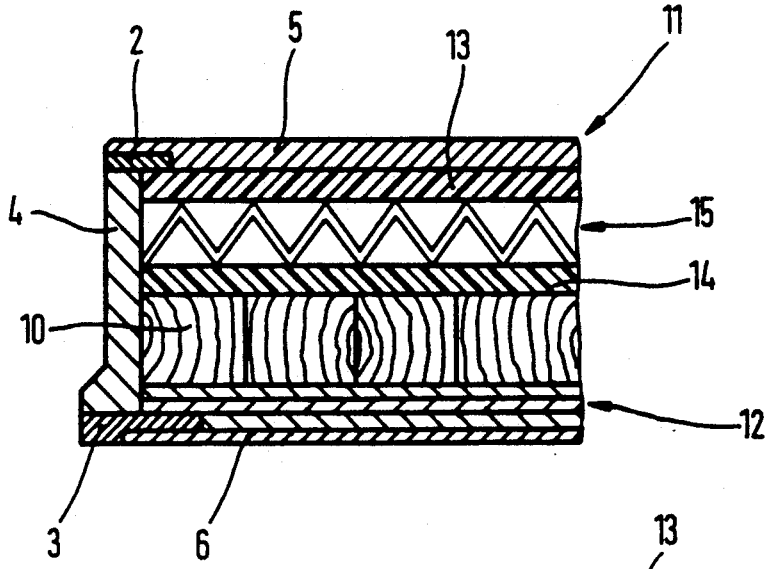
FIG. 17 is a fragementary cross sectional view of a further embodiment of the ski.

In the embodiment of FIG. 17, top sandwich web 11 is considerably thicker than bottom sandwich web 12 and is comprised of two synthetic resin layers 13, 14 covering respective surfaces of web core 15. The web core is a zig zag profile of any suitable material of the general type hereinabove mentioned.

Figure 18:
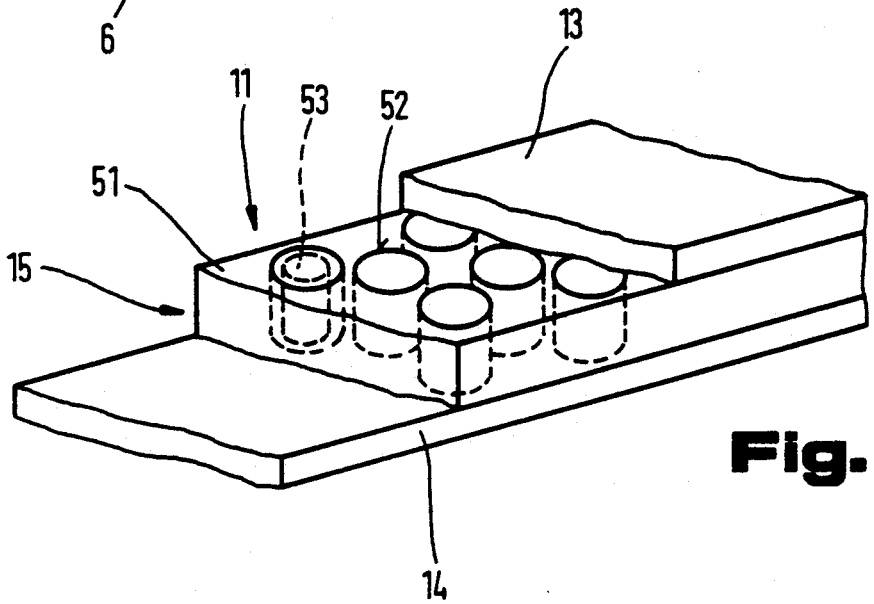
FIGS. 18 and 19 are simplified perspective views of additional embodiments of the sandwich web.

FIG. 18 shows an embodiment of sandwich web 11 whose web core 15 is comprised of a perforated metal band 51, for example of aluminum or stainless steel. The number and distribution of perforations 52 will determine the resistance to deformation of the web core. The elastic properties of band 51 may be varied and, if desired, the band may be of synthetic resin instead of metal. To prevent covering layers 13, 14 from being depressed into perforations 52, particularly in the case of relatively thick web cores, a filler 53 may be placed in the perforations before the web core is laminated, i.e. the web core may be placed on covering layer 14, the perforations may be filled, and covering layer 13 is then placed thereover.

Figure 19:
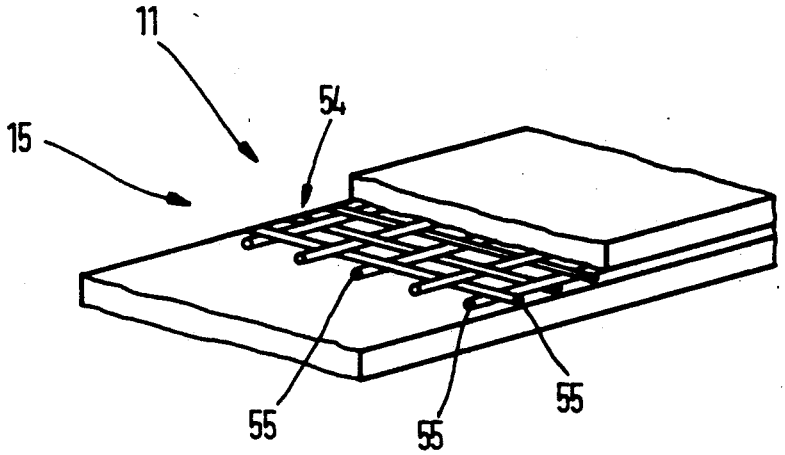

Finally, FIG. 19 shows an embodiment wherein web core 15 is comprised of woven sheet 54 consisting of filaments 55. Instead of the woven sheet, a net or any other structure of fibrous material may be used, such as a fibrous mat or an unwoven web. Any suitable fibrous material may be selected, including natural or synthetic fibers, including cotton or rayon fibers, metal fibers, coal fibers or glass fibers, or mixtures thereof.

It should be noted that, for purposes of clarity and ready understanding, the dimensions of the various layers and laminae have been greatly exaggerated in the drawing. The actual thickness of the sandwich webs of the present invention is normally no more than a few millimeters, the covering layers having, for example, a thickness of about 0.5 mm while the thickness of the web core is about 1 to 2 mm. Wood and synthetic resin ABS are very advantageous web core materials because they exhibit high shock absorption whereby not only the rigidity of the ski is enhanced but the ski also has favorable shock absorption properties.

While sandwich webs incorporated in the top and bottom webs of the ski have been illustrated, these sandwich webs being either alike, mirror-symmetrically or otherwise arranged, or different, only a single sandwich web may be used and incorporated either in the top or bottom web. However used, the sandwich web will increase the thermal stability of the ski, and it has been shown that the deformation properties of the ski incorporating such a sandwich web remains constant over a wide temperature range, for example from +20° C. to −40° C.

What is claimed is:

1. A ski comprising a multi-layered top web, a multi-layered bottom web, each one of the webs having a reinforcing sandwich element including essentially a web core and two layers covering respective surfaces of the web core incorporated therein, the web core being of a material having a deformation resistance smaller than that of the covering layers and the reinforcing sandwich elements having substantially like structural properties, a ski core arranged between the top and bottom webs, respective side ledges extending along the ski core, and respective side edges extending along the top and bottom webs.

2. The ski of claim 1, wherein the top web comprises a surface layer and the bottom web comprises a tread layer.

3. The ski of claim 2, wherein the flexing moments of the sandwich webs decreases proportionally to the distance thereof from the surface layer.

4. The ski of claim 1, wherein the covering layers and the web core of the sandwich elements are mirror-symmetrically arranged with respect to the ski core.

5. The ski of claim 1, wherein the covering layers are of different materials but have substantially the same flexing moment.

6. The ski of claim 1, wherein the covering layers are of different materials but have substantially the same shock absorbing property.

7. The ski of claim 1, wherein the covering layers are of different materials but have substantially the same thermal extensibility.

8. The ski of claim 1, wherein the covering layers are of different materials but have substantially the same hardness.

9. The ski of claim 1, wherein at least one of the covering layers is comprised of several laminae.

10. The ski of claim 9, wherein the laminae are of different materials.

11. The ski of claim 9, wherein the laminae have different thicknesses.

12. The ski of claim 9, wherein one of the covering layer laminae is comprised of an elastically yielding material.

13. The ski of claim 1, wherein one of the covering layers of the sandwich web incorporated into the top element constitutes a surface layer of the ski and one of the covering layers of the sandwich element incorporated into the bottom web constitutes a tread layer of the ski.

14. The ski of claim 1, wherein the web core is comprised of several laminae.

15. The ski of claim 1, wherein the web core is comprised of several adjacently arranged rods extending transversely to the longitudinal extension of the ski.

16. The ski of claim 1, wherein the web core is comprised of a corrugated band.

17. The ski of claim 16, wherein the corrugated web core band has ribs extending substantially parallel to the longitudinal extension of the ski.

18. The ski of claim 16, wherein the corrugated web core band has ribs extending obliquely with respect to the longitudinal extension of the ski.

19. The ski of claim 1, wherein the web core is comprised of a plurality of profiled bands, the bands having ribs oriented in directions offset from each other.

20. The ski of claim 1, wherein the web core is comprised of an elastically yielding material.

21. The ski of claim 1, wherein the web core is comprised of at least one laminae consisting of a perforated band.

22. The ski of claim 1, wherein the web core is comprised of a mat of fibrous or filamentary material.

23. The ski of claim 1, wherein the web core is comprised at least one stratum of a synthetic resin foam.

24. The ski of claim 1, wherein the web core is comprised of several laminae and one of the core web laminae is comprised of an elastically yielding material.

25. The ski of claim 1, further comprising an intermediate layer comprised of an elastically yielding material arranged between one of the covering layers and the core web.

26. The ski of claim 1, wherein at least one of the covering layers varies in thickness in a direction extending transversely to the longitudinal extension of the ski.

27. The ski of claim 1, wherein the core web varies in thickness in a direction extending transversely to the longitudinal extension of the ski.

28. The ski of claim 1, wherein the top web comprises a surface layer and the bottom web comprises a tread layer, the sandwich elements being disposed between the ski core web and the surface and tread layers, respectively.

29. The ski of claim 28, wherein the sandwich elements have a trapezoidal cross section and taper, respectively, towards the surface and tread layers.

30. The ski of claim 1, wherein the sandwich element varies in thickness in the direction of the longitudinal extension of the ski, being thinner towards the ends thereof.

31. The ski of claim 1, wherein the the side ledges are received between the sandwich elements.

32. The ski of claim 1, wherein the the side edges are disposed on the sandwich elements.

33. The ski of claim 1, further comprising an elastically yielding intermediate layer associated with the sandwich element whereby the sandwich element is displaceable relative to the ski core.

34. The ski of claim 1, wherein the reinforcing sandwich elements immediately adjoin the ski core.

* * * * *